US005178391A

United States Patent [19]

Schoen

[11] Patent Number: 5,178,391

[45] Date of Patent: Jan. 12, 1993

[54] THREE-DIMENSIONAL JIGSAW PUZZLE

[76] Inventor: Stephen J. Schoen, 10213 Gary Rd., Potomac, Md. 20854

[21] Appl. No.: 721,406

[22] Filed: Jun. 26, 1991

[51] Int. Cl.[5] ..... A63F 9/12

[52] U.S. Cl. ..... 273/153 R; 273/DIG. 14; 273/157 R

[58] Field of Search ..... 273/153 R, 156, 157 R, 273/157 A, DIG. 14

[56] References Cited

U.S. PATENT DOCUMENTS

| | | | |
|---|---|---|---|
| 2,493,697 | 1/1950 | Raczkowski | 273/156 |
| 3,510,134 | 5/1970 | Brooks et al. | 273/157 A |
| 3,981,506 | 9/1976 | Daniel et al. | 273/157 R |
| 4,815,742 | 3/1989 | Augustine | 273/157 A |

FOREIGN PATENT DOCUMENTS

| | | | |
|---|---|---|---|
| 2351623 | 4/1975 | Fed. Rep. of Germany | 273/157 A |
| 0743749 | 1/1956 | United Kingdom | 273/157 A |
| 1210452 | 10/1970 | United Kingdom | 273/157 R |

*Primary Examiner*—Vincent Millin
*Assistant Examiner*—William M. Pierce
*Attorney, Agent, or Firm*—Hoffman, Wasson & Gitler

[57] ABSTRACT

The present invention is directed to a three-dimensional jigsaw puzzle, which, when completed, produces a three-dimensional figure or form encased in a three-dimensional framing volume, such as a cube or other solid figure. The puzzle is cut into a number of horizontal slices, each of which is further broken into irregular jigsaw-like pieces.

20 Claims, 4 Drawing Sheets

THREE-DIMENSIONAL JIGSAW PUZZLE

BACKGROUND OF THE INVENTION

Many individuals, in their leisure time, take pleasure and enjoyment in solving puzzles. These puzzles can take many forms, such as the conventional crossword puzzle, diagramless puzzles, number squares, or other similar puzzles which challenge the individual's intellect and provides one with a form of mental gymnastics. Other puzzle enthusiasts enjoy the challenge of solving a two-dimensional jigsaw puzzle. However, when completed, the two-dimensional jigsaw puzzle does not allow for various views or orientations of the completed puzzle. An extension of this two-dimensional jigsaw puzzle is described, for example, in Moreau U.S. Pat. No. 3,779,558; Roy U.S. Pat. No. 4,824,112 and Ting U.S. Pat. No. 4,934,701. These patents describe puzzles in which the individual is faced with the problem of constructing a three-dimensional figure or structure from a plurality of separate pieces. For example, the patent to Roy discloses a three-dimensional puzzle building defining an enclosure whose walls are constituted as multiple, interlocking puzzle pieces. The patent to Moreau shows a puzzle system in which a plurality of puzzle pieces can be constructed to form either a two-dimensional or a three-dimensional configuration. The patent to Ting shows a three-dimensional puzzle in which a solid, three-dimensional figure is created utilizing a plurality of differently-shaped pieces.

However, none of these prior art puzzles provides the challenge of constructing a three-dimensional figure, or work of art, which is encased in a transparent or translucent three-dimensional framing volume.

SUMMARY OF THE INVENTION

The present invention overcomes the deficiencies of the prior art by providing a three-dimensional puzzle cube, or other three-dimensional form, in which a three-dimensional figure or work of art is surrounded by a transparent or translucent three-dimensional framing volume. This particular puzzle provides a visual challenge since the solution of the puzzle would require the integration of a plan view with an elevational view of the object or work of art. The three-dimensional puzzle is created by providing a plurality of three-dimensional horizontal slices, which, when combined, form the final solution to the puzzle, namely, a figure or work of art provided within a framing volume. Each of these horizontal slices is further broken up into a plurality of irregular jigsaw-like pieces, which cooperate with different pieces in their respective horizontal slice to form a portion of the three-dimensional figure and framing volume. The difficulty of the puzzle can be varied by changing the number of layers and/or the number of individual pieces per layer of the puzzle.

BRIEF DESCRIPTION OF THE DRAWINGS

Other objects and advantages of the present invention will become apparent and obvious from a study of the following description and the accompanying drawings which are merely illustrative of the present invention, wherein.

DETAILED DESCRIPTION OF THE INVENTION

Figure 1:
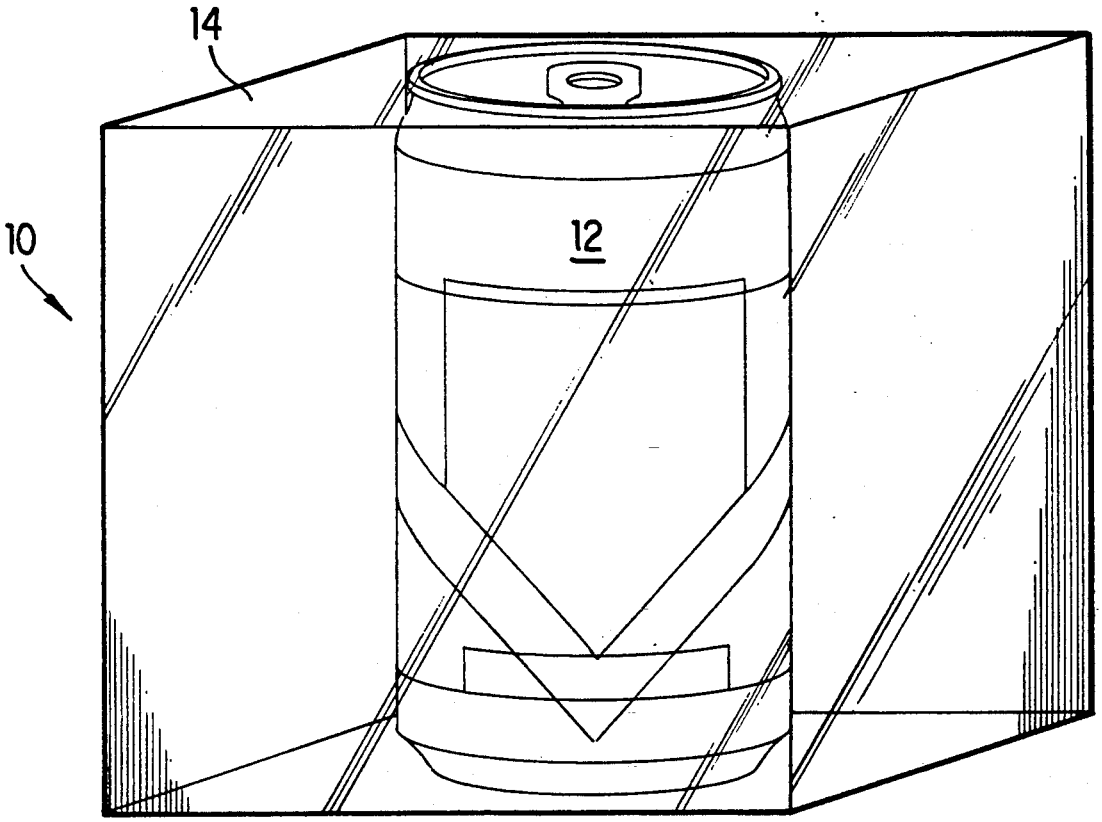
FIG. 1 is a perspective view of a completed three-dimensional figure, according to the present invention.

When completed, as illustrated with respect to FIG. 1, a three-dimensional form 10 is produced consisting of a particular FIG. 12, in this embodiment, a soft drink or beer container, encased in a three-dimensional polyhedron framing volume 14.

Figure 2:
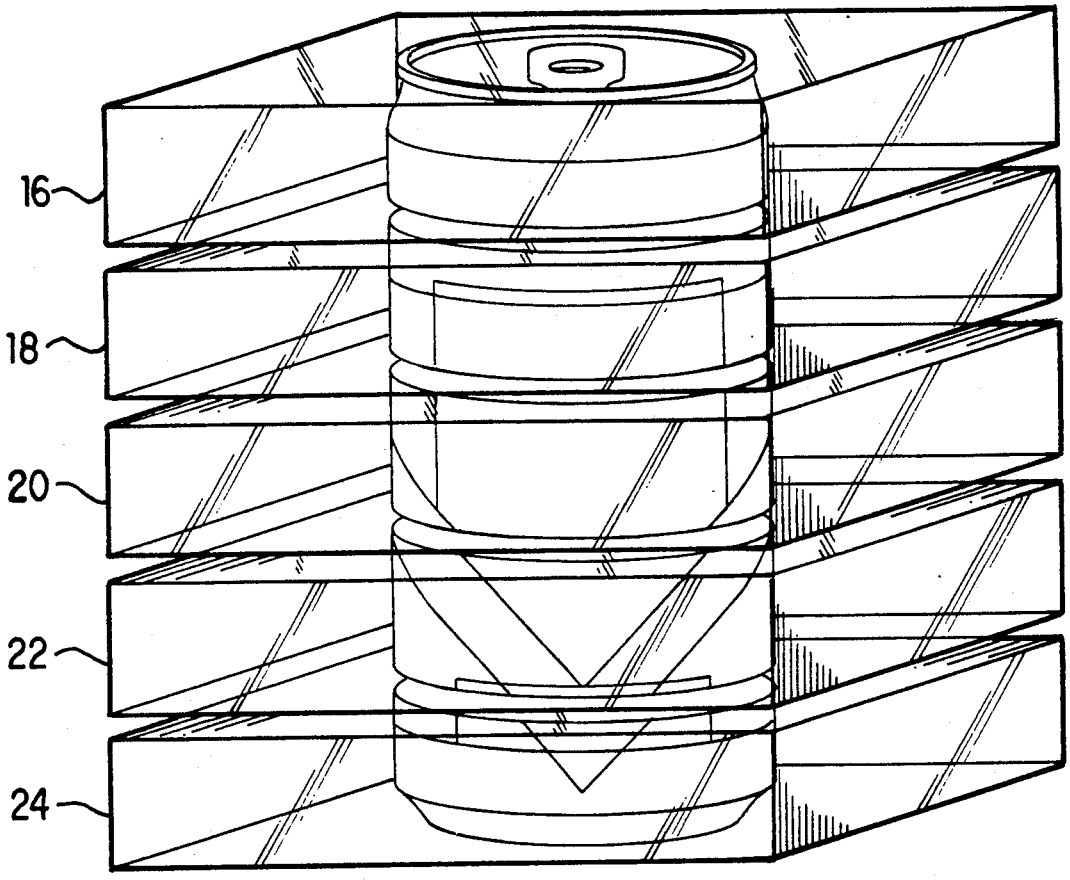
FIG. 2 is an exploded view in perspective showing the various horizontal sections of the created figure.

The three-dimensional form 12 and framing volume 14 consist of a plurality of horizontal sections 16, 18, 20, 22 and 24, as shown in FIG. 2. Although FIG. 2 divides the FIG. 12 and framing volume 14 into five horizontal sections, it can be appreciated that more or less horizontal sections can be employed.

Figure 3:
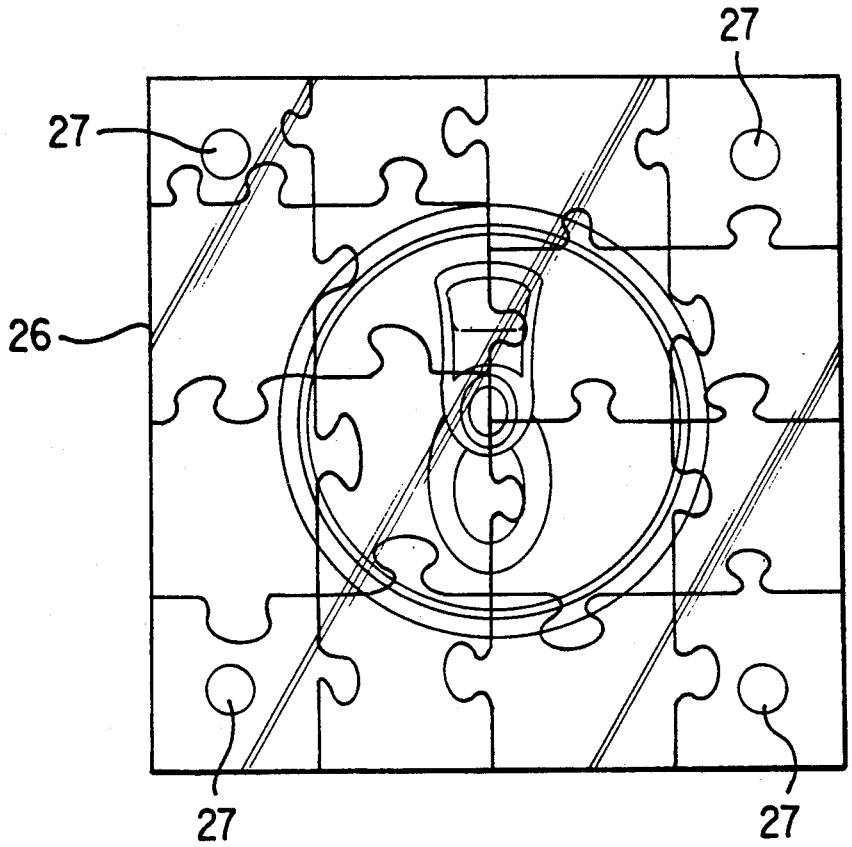
FIG. 3 is a top view of the figure showing the various interrelated jigsaw-type pieces.

Each of the horizontal sections, including both the FIG. 12 and framing volume 14, is divided into a plurality of irregularly-shaped, jigsaw-like pieces, illustrated in FIG. 3.

Figure 4:
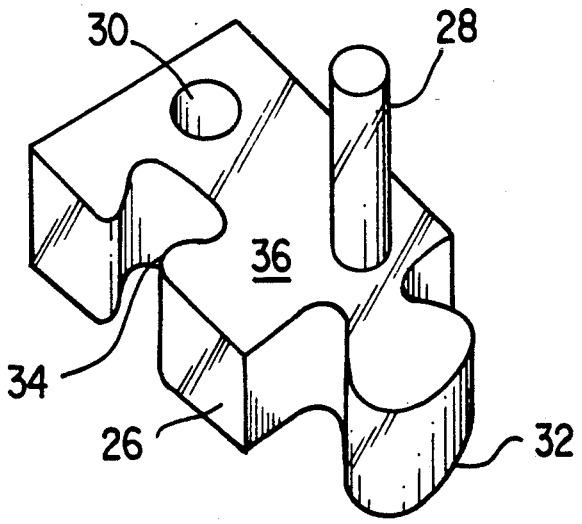
FIG. 4 is a perspective view of a typical puzzle piece according to one embodiment of the present invention.

According to one embodiment of the present invention, a typical jigsaw-like piece 26 is illustrated in FIG. 4. This piece is provided with a vertical pin 28 as well as a hole 30 which extends from a planar surface 36 of the piece 26 into the interior of the piece. The piece 26 is also provided with a plurality of ball-like extensions 32 as well as cooperating pockets 34. Each pin 28 is designed to interlock with corresponding holes 30 provided in adjacent horizontal sections of the puzzle, whereas the ball and socket arrangements of each piece 32, 34 are designed to interfit with pieces 26 included on the same horizontal section. However, it should be noted that it is not necessary for each piece to be provided with the pin 28 or the hole 30.

Another method of joining the horizontal layers together is shown in FIG. 3, in which four lucite pins 27 are provided at the corners of a completed puzzle. It can be appreciated that more or less numbers of pins will be utilized.

Each of the jigsaw-like pieces 26 is constructed from a plastic or similar transparent material. Each of the pieces 26 would either be completely transparent, thereby forming the framing volume of the puzzle, or would be completely or partially colored in a manner such that the correct, complete construction of the puzzle would produce a figure or a form of art encased in a framing volume.

Figure 5:
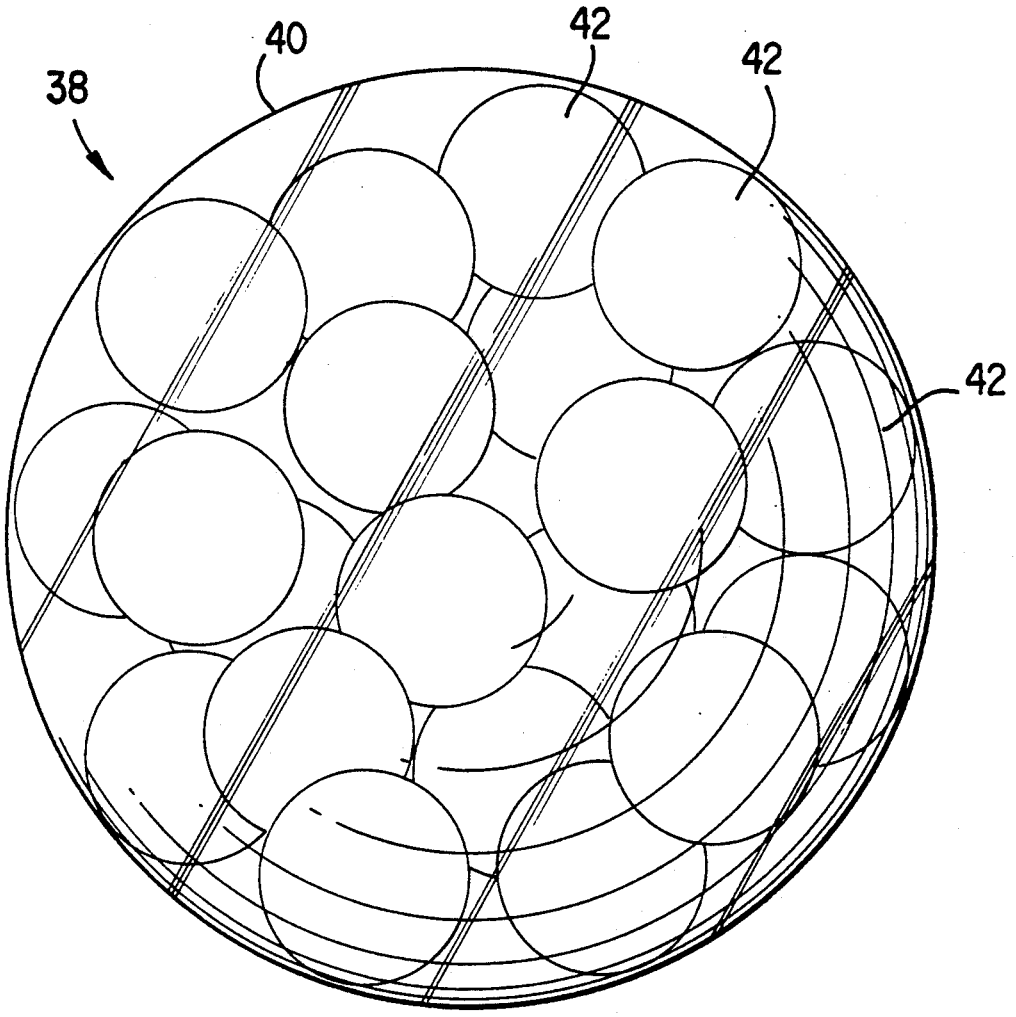
FIG. 5 is a perspective view of a second completed three-dimensional figure, according to the present invention.

The completed figure, or work of art, plus framing volume would form a cube or any type of regular or irregular three-dimensional solid figure. For example, FIG. 5 illustrates a puzzle 38 consisting of a framing volume 40 in the form of a sphere, encasing a plurality of colored, smaller spheres 42, therein. Both the framing volume and the embedded figure or object can be constructed from a lucite-type material. Additionally, the embedded object can also be constructed from virtually any other material.

The present invention, of course, may be carried out in other specific ways than that which is set forth herein without departing from the spirit and essential characteristics of the present invention. For example, it goes without saying that many different types of figures can be constructed without departing from the spirit of the present invention. Additionally, the completed puzzle can be used as a gift, in which various scenes can be displayed. Similarly, in the corporate arena, the completed puzzle can take the form of a corporate logo. Furthermore, although the present invention describes a three-dimensional jigsaw puzzle provided with a number of adjacent horizontal planes, it should be noted that the planes could be vertical or angled with respect to the vertical. Additionally, the individual planes could be contoured and not limited to flat surfaces. Therefore, the present embodiment is therefore to be considered in all aspects as illustrative, and not restrictive, and all changes coming within the meaning and equivalency range of the appended claims are intended to be embraced therein.

What is claimed is:

1. A three-dimensional jigsaw puzzle comprising:

a plurality of planes, each of said planes provided with a plurality of jigsaw-like pieces, each of said jigsaw-like pieces provided with at least one irregularly-shaped border for interlocking with at least one adjacent jigsaw-like piece provided on a similar plane, allowing the puzzle, when completed, to be easily transportable without disassembly, each of said jigsaw-like pieces being transparent or colored, or partly colored and transparent to create a three-dimensional solid image encased in a framing volume when the three-dimensional puzzle is completely assembled, said three-dimensional image produced by said colored jigsaw-like pieces and the colored portion of said partly colored jigsaw-like pieces and said framing volume produced by said transparent jigsaw-like pieces and said transparent portion of said partly colored jigsaw-like pieces, enabling said three-dimensional image and said framing volume to be viewed at all possible angles and perspectives, each of said jigsaw-like pieces used to create said three-dimensional image functioning as both a clue to complete the three-dimensional jigsaw puzzle as well as a portion of said three-dimensional image or said framing volume.

2. The three-dimensional jigsaw puzzle of claim 1, wherein each of said jigsaw-like pieces is constructed from a plastic material.

3. The three-dimensional jigsaw puzzle in accordance with claim 1, wherein a plurality of said jigsaw-like pieces is provided with a means for interfitting with jigsaw-like pieces provided in an adjacent planal section.

4. The three-dimensional jigsaw puzzle in accordance with claim 3, wherein a plurality of said jigsaw-like pieces is provided with either a hole or peg used to cooperate with a respective jigsaw-like piece provided in an adjacent planal section.

5. The three-dimensional jigsaw puzzle in accordance with claim 4, wherein each of said jigsaw-like pieces is provided with either a hole or a peg.

6. The,,three-dimensional jigsaw puzzle in accordance with claim 1, wherein said framing volume is a polyhedron.

7. The three-dimensional jigsaw puzzle in accordance with claim 1, wherein said framing volume is a sphere.

8. The three-dimensional jigsaw puzzle in accordance with claim 1, further including at least one pin extending vertically from the top surface of the jigsaw puzzle to the bottom surface of the jigsaw puzzle.

9. The three-dimensional jigsaw puzzle in accordance with claim 1, wherein each of said planes are parallel with one another.

10. The three-dimensional jigsaw puzzle in accordance with claim 9, wherein each of said planes are horizontal.

11. A three-dimensional jigsaw puzzle comprising:

a plurality of planes, each of said planes provided with a plurality of jigsaw-like pieces, each of said jigsaw-like pieces provided with at least one irregularly-shaped border for interlocking with at least one adjacent jigsaw-like piece provided on a similar plane, allowing the puzzle, when completed, to be easily transportable without disassembly, each of said jigsaw-like pieces being transparent or colored, or partly colored and transparent to create a three-dimensional solid image encased in a framing volume when the three-dimensional puzzle is completely assembled, said three-dimensional image produced by said transparent jigsaw-like pieces and the transparent portion of said partly transparent jigsaw-like pieces and said framing volume produced by said colored jigsaw-like pieces and said colored portion of said partly colored jigsaw-like pieces, enabling said three-dimensional image and said framing volume to be viewed at all possible angles and perspectives, each of said jigsaw-like pieces used to create said three-dimensional image functioning as both a clue to complete the three-dimensional jigsaw puzzle as well as a portion of said three-dimensional image or said framing volume.

12. The three-dimensional jigsaw puzzle of claim 11, wherein each of said jigsaw-like pieces is constructed from a plastic material.

13. The three-dimensional jigsaw puzzle in accordance with claim 11, wherein a plurality of jigsaw-like pieces is provided with a means for interfitting with jigsaw-like pieces provided in an adjacent planar section.

14. The three-dimensional jigsaw puzzle in accordance with claim 11, wherein said framing volume is a polyhedron.

15. The three-dimensional jigsaw puzzle in accordance with claim 11, wherein said framing volume is a sphere.

16. The three-dimensional jigsaw puzzle in accordance with claim 13, wherein a plurality of said jigsaw-like pieces is provided with a hole or peg used to cooperate with the respective jigsaw-like piece provided in an adjacent planar section.

17. The three-dimensional jigsaw puzzle in accordance with claim 16, wherein each of said jigsaw-like pieces provided with either a hole or a peg.

18. The three-dimensional jigsaw puzzle in accordance with claim 11, further including at least one pin extending vertically from the top surface of the jigsaw puzzle to the bottom surface of the jigsaw puzzle.

19. The three-dimensional jigsaw puzzle in accordance with claim 11, wherein each of said planes is parallel with one another.

20. The three-dimensional jigsaw puzzle in accordance with claim 19, wherein each of said planes is horizontal.

* * * * *